US010697140B2

(12) United States Patent
Wenger

(10) Patent No.: US 10,697,140 B2
(45) Date of Patent: Jun. 30, 2020

(54) MOVABLE CRASH BARRIER SECTION

(71) Applicant: WENGER, PROJEKTE UND COACHING, Morgarten (CH)

(72) Inventor: Hermann Wenger, Morgarten (CH)

(73) Assignee: WENGER, PROJEKTE UND COACHING, Morgarten (CH)

( * ) Notice: Subject to any disclaimer, the term of this patent is extended or adjusted under 35 U.S.C. 154(b) by 0 days.

(21) Appl. No.: 16/067,914

(22) PCT Filed: Jan. 3, 2017

(86) PCT No.: PCT/EP2017/050042
§ 371 (c)(1),
(2) Date: Jul. 3, 2018

(87) PCT Pub. No.: WO2017/118620
PCT Pub. Date: Jul. 13, 2017

(65) Prior Publication Data

US 2019/0301117 A1 Oct. 3, 2019

(30) Foreign Application Priority Data

Jan. 5, 2016 (WO) ..... PCT/EP2016/050059

(51) Int. Cl.
*E01F 15/00* (2006.01)
*E01F 15/08* (2006.01)

(52) U.S. Cl.
CPC ..... *E01F 15/006* (2013.01); *E01F 15/08* (2013.01); *E01F 15/085* (2013.01); *E01F 15/088* (2013.01)

(58) Field of Classification Search
CPC ..... E01F 15/06; E01F 15/08; E01F 15/085; E01F 15/088
(Continued)

(56) References Cited

U.S. PATENT DOCUMENTS 4,632,598 A * 12/1986 Richards ..... E01F 15/006 404/6
4,666,332 A * 5/1987 Burgett ..... E01F 15/006 404/12

(Continued)

FOREIGN PATENT DOCUMENTS

DE 4219572 A1 12/1993
DE 60014502 T2 2/2006

(Continued)

OTHER PUBLICATIONS

Written Opinion filed in corresponding PCT Application No. PCT/EP2017/050042 dated Apr. 12, 2017.

(Continued)

*Primary Examiner* — Raymond W Addie

(74) *Attorney, Agent, or Firm* — Davis & Bujold PLLC; Michael J. Bujold

(57) ABSTRACT

A crash barrier section (1) comprising a deflection body with at least one traveling gear (3) that is movable between a standby position and a displacement position. The at least one traveling gear (3) is retracted into the standby position in a receptacle (4) of the deflection body and is extended in the travel position from the receptacle (4) in such a manner that the crash barrier section (1) is movable on a support (5), in particular a road section. The crash barrier section (1) additionally comprises a lifting device (6) by which the crash barrier section (1) can be raised from the support (5) for extending and retracting the traveling gear (3).

16 Claims, 13 Drawing Sheets

(58) Field of Classification Search
USPC ..... 404/6
See application file for complete search history.

(56) References Cited

U.S. PATENT DOCUMENTS

| | | | | |
|---|---|---|---|---|
| 5,007,763 | A * | 4/1991 | Burgett | E01F 15/006 404/6 |
| 6,402,421 | B1 | 6/2002 | Ottavi et al. | |
| 6,485,224 | B1 * | 11/2002 | Dyke | E01F 15/006 16/250 |
| 6,832,870 | B1 * | 12/2004 | Krivoy | E01F 15/006 404/6 |
| 8,647,012 | B2 * | 2/2014 | Wilkinson | E01F 15/12 256/13.1 |
| 8,864,408 | B1 * | 10/2014 | Dyke | B60P 3/40 404/73 |
| 9,073,471 | B1 * | 7/2015 | McIntosh | B60P 3/07 |
| 2001/0048845 | A1 * | 12/2001 | Jack | E01F 13/08 404/6 |
| 2008/0286042 | A1 * | 11/2008 | Dyke | E01F 15/006 404/6 |
| 2016/0168809 | A1 * | 6/2016 | Groeneweg | E01F 15/148 404/6 |

FOREIGN PATENT DOCUMENTS

| | | | |
|---|---|---|---|
| DE | 102011053263 | A1 | 3/2013 |
| DE | 102013101776 | B3 | 8/2014 |
| EP | 1061178 | A1 | 12/2000 |
| EP | 2784221 | A1 | 10/2014 |
| WO | 2014/127763 | A2 | 8/2014 |

OTHER PUBLICATIONS

International Search Report filed in corresponding PCT Application No. PCT/EP2017/050042 dated Apr. 12, 2017.

* cited by examiner

MOVABLE CRASH BARRIER SECTION

This application is a national stage completion of PCT/EP2017/050042 filed Jan. 3, 2017 which is a continuation in part of International Application No. PCT/EP2016/050059 filed Jan. 5, 2016.

FIELD OF THE INVENTION

The present invention relates to a crash barrier section according to the preamble of claim 1, a crash barrier system according to the preamble of claim 10, a road turnout according to the preamble of claim 11, and a method for shifting a crash barrier section according to the preamble of claim 15.

BACKGROUND OF THE INVENTION

Crash barriers, also referred to as traffic barriers or guard rails, are passive retaining systems, which are usually made of steel, on roads. They are used fundamentally to prevent vehicles, in particular passenger vehicles or trucks, from drifting onto the wrong side of the road and from leaving the roadway. On the one hand, areas outside the roadway are thus protected against vehicle impact, and on the other hand serious effects on the vehicle caused by the vehicle descending a slope or caused by a collision, for example with oncoming traffic or with tree growth, can be prevented. Furthermore, a reduction of the potential consequences of an accident is provided, this being achieved by absorption of the kinetic energy of the vehicle by deformation of the crash barrier during the course of a collision.

Since the arrival of motorised road traffic, fixedly installed crash barrier systems in particular have become widespread. However, nowadays, mobile systems are also widespread, particularly for the safeguarding of construction sites. Particular requirements are placed on systems of this kind in particular in the case of use on high-capacity roads, where, due to the extremely high volume of traffic, a mobile crash barrier has to be installed within a particularly short space of time. However, in particular in the case of said high-capacity roads, particular requirements are also placed on the versatility of crash barrier systems. For example, pivotable, semi-mobile systems with which the traffic can be guided electively into one of two different lanes are currently in existence. In addition, in particular in the case of central crash barriers, fixedly installed closure systems are also known, by means of which a crash barrier can be opened as desired and the traffic can be diverted into the oncoming lane. Due to the continuously increasing volume of traffic, semi-mobile crash barrier systems that can be shifted between different lanes depending on the traffic situation have also been introduced more recently. For example, it is thus conceivable to operate a five-lane high-speed road in morning traffic with three lanes in one direction and two lanes in an other direction and, during the course of the day, to shift the central crash barrier so as to operate the road during the evening rush hour with two lanes in the one direction and three lanes in the other direction.

In order to satisfy these requirements, a series of shiftable and movable crash barrier systems are known in the prior art. For example, EP 2 784 221 A1 describes a crash barrier system comprising an extendible travelling gear device. This system makes it possible to displace a crash barrier section in its transverse direction. However, due to the arrangement of the travelling gear device, no other direction of displacement is possible. In addition, in the case of this system, due to the design, the entire weight of the crash barrier section is supported on the travelling gear device as it is extended, which can imply a significant mechanical loading. The object of the invention is therefore to overcome the disadvantages in the prior art.

SUMMARY OF THE INVENTION

In particular, the object of the invention is to create a displaceable crash barrier system that can be used in a versatile manner and can be arbitrarily extended. Nevertheless, it must satisfy the highest safety requirements. It should be possible to integrate the system into existing crash barrier systems and to produce the system economically. The system should have compact dimensions, yet still be usable in combination with systems that have a relatively high inherent weight per length unit.

These objects are achieved by a crash barrier section having the features in claim 1. Said crash barrier section comprises a deflection body, which extends in particular in a longitudinal direction and which has at least one travelling gear that is movable between a standby position and a displacement position. The at least one travelling gear is retracted in the standby position in a receptacle of the deflection body and is extended in the displacement position from the receptacle in such a manner that the crash barrier section is movable on a support, in particular a road section. The crash barrier section additionally comprises a lifting device, in particular comprising a pressurised-medium cylinder, preferably a hydraulic cylinder, more preferably an oil or water hydraulic cylinder, by which the crash barrier section can be raised from the support for extending and retracting the travelling gear. However, the lifting device for this purpose can also comprise a spindle drive, a ratchet and pawl winch, or another driven or manual lifting means.

Due to the use of a lifting device of this kind, the weight of the crash barrier section can be prevented from acting on the travelling gear as this is being extended and retracted. Undesired overloading of the travelling gear can thus be avoided. This is necessary in certain cases, since the maximum weight loading of the travelling gear during retraction and extension may be lower than in the extended state. Accordingly, a relatively small and space-saving travelling gear can also be integrated in a relatively heavy crash barrier section and can move said crash barrier section. In addition, a lifting device can be necessary if it is not possible to control the travelling gear in the loaded state.

The deflection body can have a substantially U-shaped, downwardly open cross-sectional profile in the longitudinal direction, which cross-sectional profile forms the receptacle and from which the travelling gear and the lifting device can be extended. Mobile crash barrier systems with cross-sectional profiles of this kind are nowadays already widely used, whereby the crash barrier section described here lends itself ideally as a modular extension of the aforesaid crash barrier systems. In addition, a deflection body designed in this way must not be altered in terms of its structure in order to integrate a travelling gear or a lifting device, whereby its safeguarding against impact is maintained at all times. In addition, there is no need to attach any additional parts externally to the crash barrier section, these potentially posing a risk for a vehicle drifting out of the lane.

The at least one travelling gear can be mounted pivotably or rotatably, in particular individually. In particular, the at least one travelling gear can be mounted pivotably or rotatably in such a way that its direction of travel can be controlled, in particular individually.

In this context, the term "can be controlled" means that the direction of travel of the travelling gear can be influenced as desired. This can be implemented on the one hand in a state in which the travelling gear is in contact with the support. However, it is also possible in a state in which the travelling gear is raised from the support.

Due to the pivotable or rotatable mounting of the at least one travelling gear, the crash barrier section can be moved optionally in different directions, whereby it can be used in a particularly versatile manner. In the case of crash barrier sections, or even crash barrier systems, having a plurality of travelling gears, the possibility to individually control the at least one travelling gear is particularly key, since systems of this kind thus can be extended arbitrarily. Particularly in this context, the crash barrier section can be designed in such a way that it can be integrated into existing crash barrier systems. Originally immobile systems can thus also be retrofitted in such a way that they can be moved in a versatile manner along their transverse or longitudinal direction, or any direction in between.

The at least one travelling gear can be mounted pivotably or rotatably about an in particular vertically oriented height axis. In particular, the at least one travelling gear, in order to control its direction of travel, can be mounted pivotably or rotatably about an in particular vertically oriented height axis. A design of the travelling gear of this kind constitutes a possibility for particularly reliable and mechanically simple control. By means of the vertical orientation of the height axis, the forces acting thereon during the course of a control process are minimised.

With a pivotable or rotatable design, the travelling gear can be retracted into the standby position with a direction of travel in the longitudinal direction of the crash barrier section, and in the displacement position a direction of travel in the transverse direction of the crash barrier section can be provided. Here, the travelling gear can comprise at least two rollers arranged in succession in the direction of travel, wherein the axial spacing of the at least two rollers at least in the displacement position is greater than the maximum cross-sectional width of the receptacle. This makes it possible to provide a travelling gear that in the retracted state is particularly space saving, since with a crash barrier section of this kind the extent of the receptacle in the transverse direction is limited in particular. Accordingly, the crash barrier section can be made relatively slim in this way.

Here, the travelling gear can be pivotable or rotatable simultaneously during the extension and/or retraction, in particular via a slotted guide. The extension and/or retraction process can thus be made more efficient. In particular by means of a slotted guide, a simultaneous extension or retraction and rotation of the travelling gear can also be provided in a mechanically simple and reliable manner. Here, the reliability is relevant in particular since a mere extension of the travelling gear without rotation or pivoting can cause the crash barrier section to tip over, depending on its design. However, a combined rotary or pivoting and extension or retraction movement can also be attained with what is known as a rotary lifting cylinder, as is known in the prior art and as is commercially available. A design of this kind offers greater flexibility, particularly if it is also necessary to move the crash barrier section in various directions. In addition, a high level of reliability can be attained here also by a pneumatic or hydraulic coupling of the rotary and lifting movement.

The at least one travelling gear can be formed as a supporting travelling gear, and the crash barrier section can additionally comprise at least one bearing travelling gear, which can be retracted into a standby position in the receptacle of the deflection body and can be extended into a displacement position outside the receptacle of the deflection body. By using a bearing travelling gear, the force of the weight acting on the supporting travelling gear can be reduced. This leads in particular to a reduction of the contact pressure acting on the support surface.

The at least one bearing travelling gear can comprise at least two coaxially arranged rollers with a direction of travel in the transverse direction of the crash barrier section. By means of an arrangement of the rollers of this kind, the spatial requirement of the bearing travelling gear in the receptacle of the crash barrier section, in particular in the transverse direction thereof, can be reduced. Accordingly, the crash barrier section can be made relatively slim in this way.

The supporting travelling gear and the bearing travelling gear can be mechanically coupled to one another for retraction and/or extension. The crash barrier section can thus be retracted and/or extended using just one mechanism.

The at least one travelling gear can comprise at least two rocker arms pivotable in opposite directions about a common axis, with rollers attached to the free ends of said rocker arms, wherein the rocker arms can be pivoted away from one another as the travelling gear is extended and can be pivoted together as the travelling gear is retracted. This makes it possible to provide a travelling gear that is particularly space saving in the retracted state.

In the case of a travelling gear of this kind, the angle enclosed by the rocker arms in the displacement position can be greater than 90°, preferably greater than 120°, more preferably greater than 150°. A particularly preferred angle for a travelling gear of this kind is, in addition, 180°. With a selected travelling gear geometry of this kind, a distance between the rollers attached at the free ends of the rocker arms that ensures good stability of the crash barrier section in the extended state of the travelling gear can be achieved.

The at least one travelling gear can additionally comprise pairs of rollers arranged along a height axis. It is thus ensured that the stability of the crash barrier section is ensured in any arbitrary control position.

The at least one travelling gear can comprise at least one caterpillar track running on the rollers, and as necessary also on intermediate rollers, said track preferably being in the form of a toothed belt. Due to the use of a caterpillar track, the weight per unit of area exerted by the travelling gear onto the support can be reduced. This is of significance in particular in the case of use in construction sites, where the ground can be soft and also uneven. However, the presence of a caterpillar track can also be relevant when moving on a tarmac roadway, in particular when this is heated in summer by increased solar radiation and is thus deformable.

The at least one rocker arm can additionally comprise a finger protruding beyond its pivot point, which finger maintains the tension of the caterpillar track as the travelling gear is pivoted together. An embodiment of this kind makes it possible to always hold the caterpillar track under a well-defined tension, thus ensuring that said track is always reliably guided over the rollers. In addition, the caterpillar track can be prevented from slipping from the rollers as the travelling gear is retracted.

The at least one travelling gear with its direction of travel transverse to the longitudinal direction of the crash barrier section can be retracted into the standby position in the receptacle. The axial spacing of rollers mounted on opposite rocker arms in the displacement position can be greater here than the maximum cross-sectional width of the receptacle.

By retracting and pivoting together the travelling gear with its direction of travel transverse to the longitudinal direction of the crash barrier section into the standby position, the travelling gear can be housed in the receptacle of the deflection body in a particularly space-saving manner. Accordingly, the crash barrier section can be made relatively slim in this way.

The at least one travelling gear, in particular formed as a supporting travelling gear, and/or the at least one bearing travelling gear, can comprise a drive, in particular an electric motor or a hydraulic motor, preferably an oil or water hydraulic motor. Drives of this kind have become established in the prior art and can be easily integrated into the described system. With use of an electric motor, this can be supplied with power both by means of an external power supply and by means of batteries fitted in the receptacle of the deflection body. With use of a hydraulic motor it is on the one hand conceivable to power this externally with hydraulic medium, but on the other hand a hydraulic module can also be installed within the receptacle of the deflection body. A water hydraulic motor, compared to an oil hydraulic motor, has the advantage here that the risk to the environment posed by any potentially leaking hydraulic medium is minimised.

A crash barrier section of this kind can comprise at least 2, in particular 3, 4, 5, 6, 7, 8, 9 or 10 travelling gears, in particular supporting travelling gears and/or bearing travelling gears, by which the crash barrier section is movable, wherein the travelling gears preferably can be controlled simultaneously, but in particular also individually. It is thus clear that the described crash barrier section can be adapted in terms of design to the particular requirements in a versatile manner. The simultaneous control of the travelling gears makes it particularly easy for a user to move the crash barrier section. The travelling gears can be controlled via one or more control units mounted on the deflection body. However, it is also possible to control the travelling gears via wired control or wireless remote control. In addition, variants are also conceivable in which the travelling gears are controlled via a computer program, which is installed on a mobile telephone known in the prior art. Since each travelling gear can be controlled individually, and more preferably also can be driven individually, the system can be extended arbitrarily.

A crash barrier section can comprise at least 2, in particular 3, 4, 5, 6, 7, 8, 9 or 10 lifting devices. With regard to the number of lifting devices, the crash barrier section described here can also be easily adapted in terms of design to the particular purpose of use.

Within the scope of the present invention, the exact embodiment of the crash barrier section, in particular the design, number and arrangement of the travelling gear or of the travelling gears, or of the lifting device or the lifting devices, can be adapted to the particular purpose of use. For example, the size and the shape of the deflection body can constitute key basic conditions. Other relevant factors are the type and duration of use of the crash barrier section and/or the nature of the support on which said crash barrier section is to be moved.

A further aspect of the present invention relates to a crash barrier system which comprises a plurality of adjustable crash barrier segments, which can be connected to one another at their end faces so as to have high tensile strength, in particular in a form-fitting manner, optionally additionally also in a frictionally engaged manner. Here, at least one movable crash barrier segment, in particular a crash barrier section as described above, can be inserted between two adjustable crash barrier segments. The adjustable crash barrier systems thus can be lifted and can be moved. A crash barrier system of this kind offers the advantage that it can be used in an extremely versatile manner, in particular on high-capacity roads, preferably in the region of construction sites. There are many possibilities for quickly adapting the traffic management to the particular requirements, and yet a very high level of safety is still provided in the event of a vehicle impact.

In the case of a crash barrier system of this kind, the length of the adjustable crash barrier segments can be 5 to 20 m, preferably 8 to 16 m, more preferably 10 to 14 m. Crash barrier segments having lengths of this kind have proven their worth for mobile crash barrier systems. Segments of this kind can still be easily transported by means of a truck and still offer sufficient efficiency in respect of their quantity.

The present invention additionally relates to a road turnout having at least one adjustable switch, in particular two adjustable switches, each comprising at least one crash barrier section of the above-described kind. For example, with a road turnout of this kind, it is possible to change the traffic management of a high-capacity road from four to three lanes.

In the case of a road turnout of this kind, the at least one switch can be mounted pivotably in the horizontal direction about a substantially vertically oriented axis. However, the at least one switch can also be designed so as to be flexible in the horizontal direction, in particular by means of the flexible connection of individual crash barrier sections, which can be connected to one another at their end faces so as to have high tensile strength, in particular in a form-fitting manner, and optionally additionally also in a frictionally engaged manner. In particular, a flexible design of the switch or switches offers the advantage of avoiding a kink in the crash barrier. The risk posed to a vehicle in the event of an impact can thus be significantly reduced.

Both in the case of the above-described crash barrier system and in the case of the road turnout, it is advantageous if a plurality of travelling gears can be controlled sequentially or simultaneously, but in any case individually. As will be explained in greater detail hereinafter, the course of the lane can thus be defined in a targeted manner by moving the crash barrier sections.

The present invention additionally relates to a method for shifting a crash barrier section, in particular a crash barrier section as described above, said method comprising the following steps:

i. moving, in particular extending, at least one travelling gear from a standby position into a displacement position;

ii. moving the crash barrier section on a support, in particular on a road section, by means of the at least one travelling gear;

iii. moving, in particular retracting, the at least one travelling gear from a displacement position into a standby position.

In order to move the at least one travelling gear into the standby position or the displacement position, the crash barrier section is raised from the support by means of a lifting device, preferably comprising a pressurised-medium cylinder, more preferably an oil or water hydraulic cylinder, and is then lowered again.

Optionally the direction of travel of the at least one travelling gear can be selected, preferably can be controlled, before or during step ii., in particular by a pivoting motion or rotation about a vertically oriented height axis (H). Optionally, the crash barrier section can be raised from the support by the lifting device in order to choose, preferably control, the direction of travel, and can then be lowered again.

BRIEF DESCRIPTION OF THE DRAWINGS

Further advantages and individual features of the invention will become clear from the following description of an exemplary embodiment and from the drawings.

The drawings show schematically.

DETAILED DESCRIPTION OF THE PREFERRED EMBODIMENTS

Figure 1:
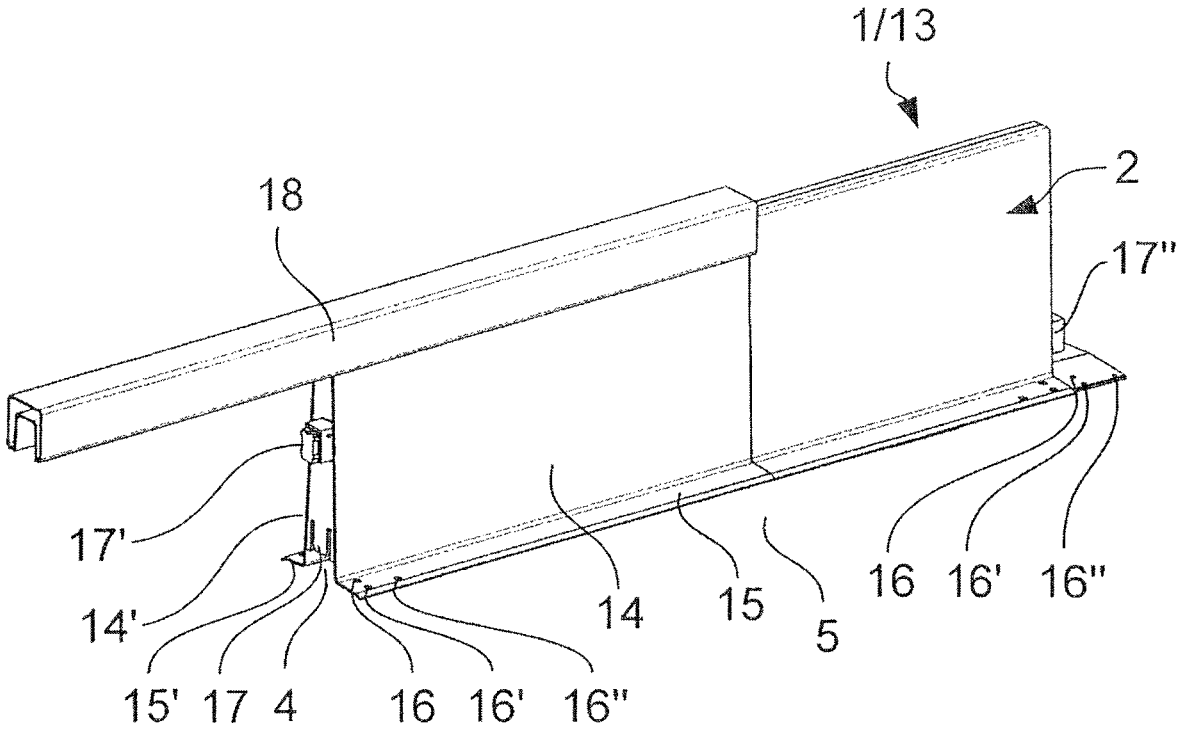
FIG. 1: a perspective depiction of a crash barrier section according to the invention with at least one travelling gear in standby position and an optional retracted lifting device.

As can be seen from FIG. 1, a crash barrier section 1 according to the Invention comprises a deflection body 2, which is composed of two limbs 14 and 14'. The practically vertically extending limbs 14 and 14' transition at their lower ends into the substantially horizontally extending end portions 15 and 15', which form a support for the crash barrier section 1. An upper termination profile 18 is fitted onto the deflection body 2.

Both the deflection body 2 and the termination profile 18 are manufactured from galvanised steel. This is a material which is relatively inexpensive and yet offers an extremely high mechanical stability. In addition, galvanised steel has long-lasting resistance to corrosion and at the end of the service life of the crash barrier section can be recycled in an environmentally friendly manner.

The hooking elements 17, 17' and 17" are attached in the end regions of the crash barrier section 1. Said hooking elements make it possible to establish a stable connection, with high tensile strength, between successive crash barrier sections 1 or crash barrier segments 13 of a crash barrier in a simple and efficient way. The crash barrier section 1 additionally comprises screw holes 16, 16' and 16" in the substantially horizontally extending end portions 15 and 15' of the limbs 14 and 14' of the deflection body. Adjacent crash barrier sections 1 can be additionally screwed to one another as a result of these adjacent screw holes 16, 16', 16". The screwing of the crash barrier sections 1 additionally guarantees a secure connection thereof, even if they were to be lifted by the impact of a vehicle.

In the case of the present exemplary embodiment, in terms purely of external appearance a crash barrier section 1 according to the invention differs only slightly from an adjustable crash barrier segment known in the prior art.

Figure 2:
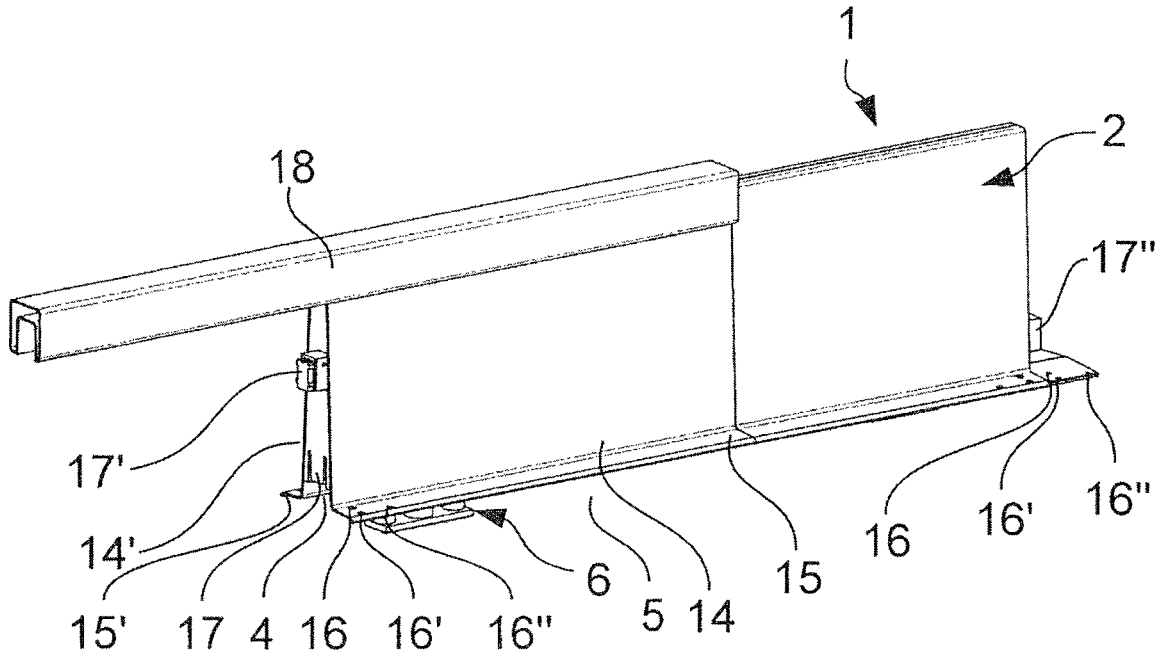
FIG. 2: a perspective depiction of a crash barrier section according to the invention with extended lifting device.

As can be seen from FIG. 2, the crash barrier section 1 according to the invention can be raised from a support 5 by extending the lifting device 6 from the receptacle 4 formed by the deflection body 2.

Figure 3:
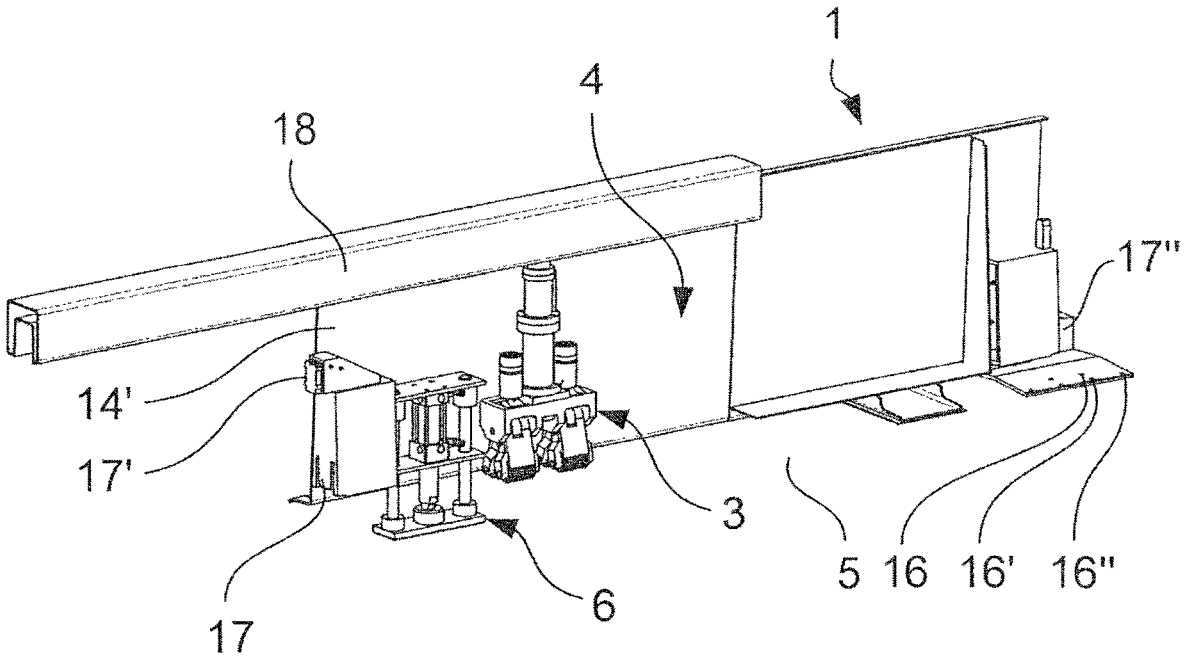
FIG. 3: depiction according to FIG. 2, but with the front limb of the deflection body removed.

FIG. 3 shows a drawing corresponding to FIG. 2, but with the front limb 14 of the deflection body 2 removed. Accordingly, it can be clearly seen in said drawing that a travelling gear 3 and the lifting device 6 are arranged within the receptacle 4. In addition, further components of the crash barrier section 1 according to the invention which are not shown in the present depiction, such as a hydraulic module 26 or batteries for supplying power to the system, can also be arranged within the receptacle 4.

Figure 4:
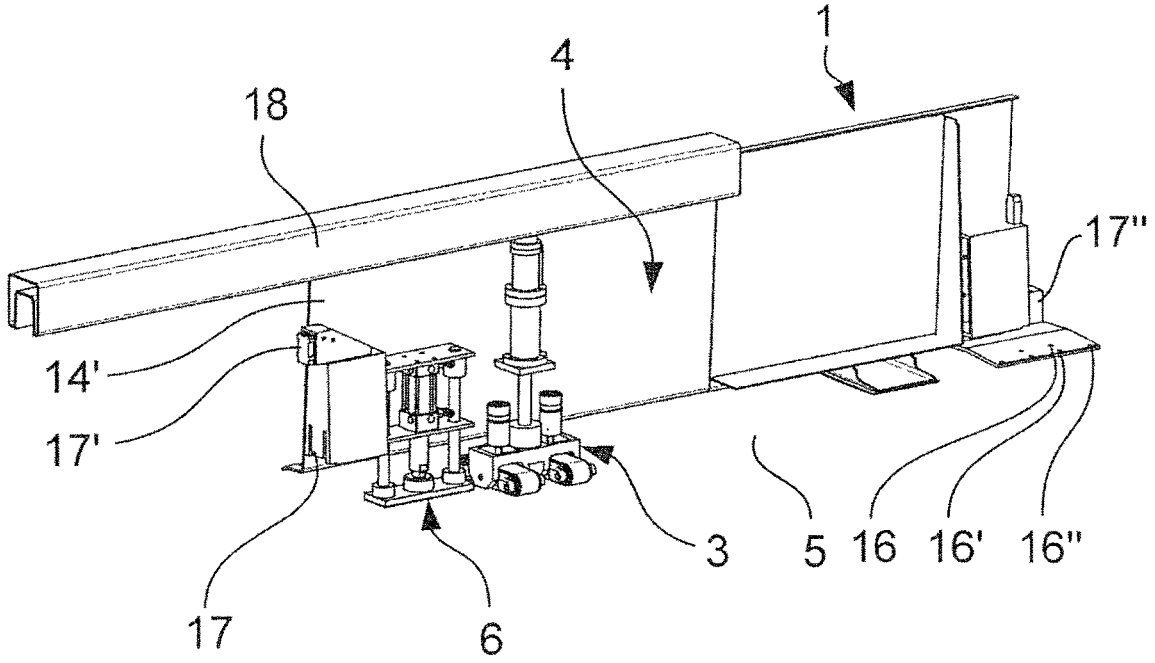
FIG. 4: depiction according to FIG. 3, but additionally with the lifting device in the displacement position.
Figure 5:
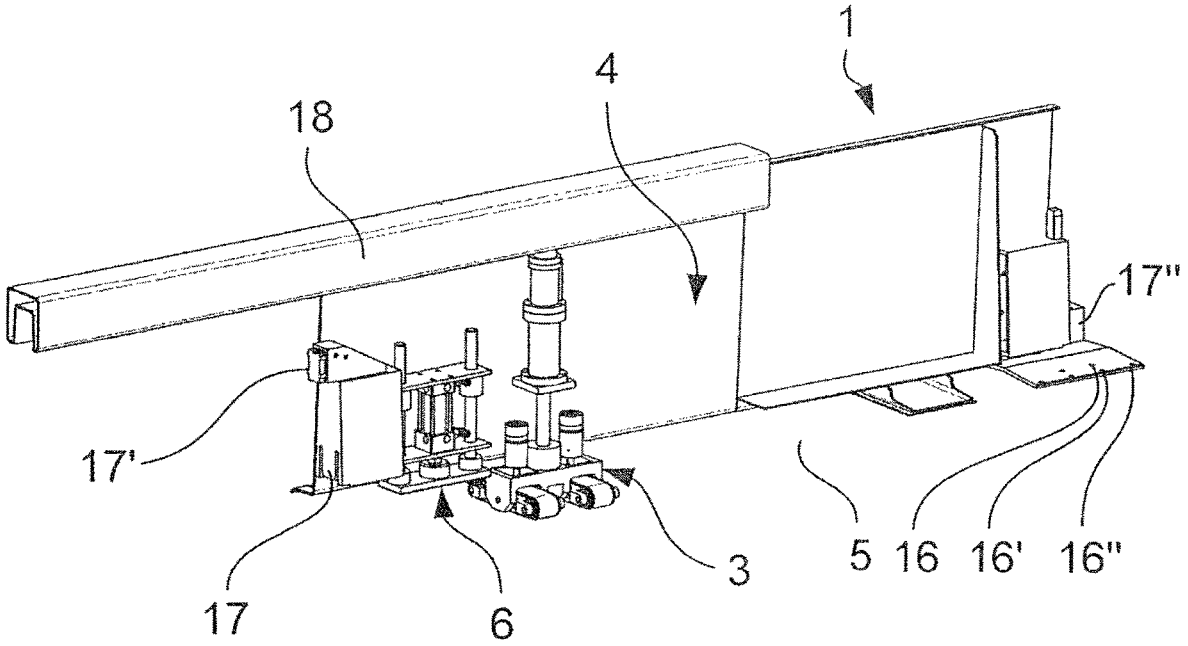
FIG. 5: depiction according to FIG. 4, but with the lifting device retracted.

In FIG. 4, in addition to the lifting device 6, the travelling gear 3 is also extended from its standby position in the receptacle 4 into its displacement position. The travelling gear 3 can be designed in such a way that it can be controlled even under full loading by the weight of the crash barrier section 1 and any further adjustable crash barrier segments 13 connected thereto. The lifting device 6 can be retracted into the receptacle 4 of the deflection body 2 in order to control the direction of travel of the travelling gear 3, as is shown in FIG. 5.

Figure 6:
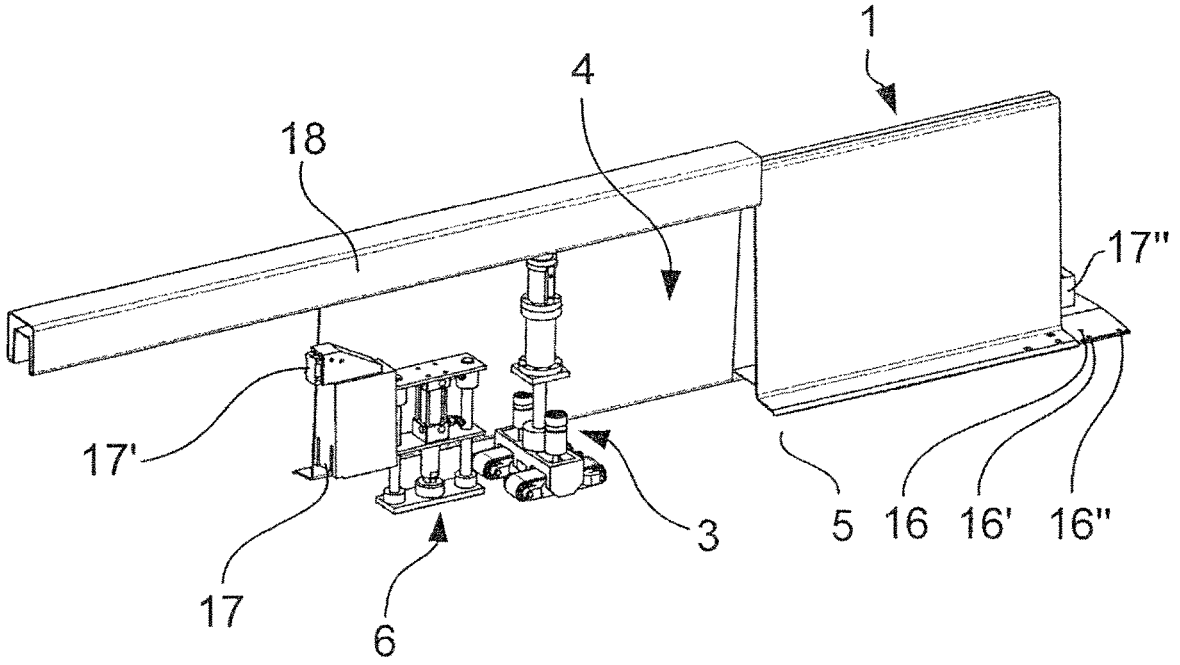
FIG. 6: depiction according to FIG. 4, but with the travelling gear pivoted through 90 degrees.

However, the travelling gear 3 can also be designed in such a way that it cannot be controlled under load. Then, the travelling gear 3 can be easily raised from the support in the extended state in its displacement position by means of the lifting device 6 and can then be rotated or pivoted about a vertically oriented height axis, as in the present exemplary embodiment. The travelling gear is thus pivoted for example through 90 degrees in FIG. 6. Accordingly, the crash barrier section 1, as shown in FIG. 7, can be moved along its longitudinal direction with retracted lifting device 6.

Figure 7:
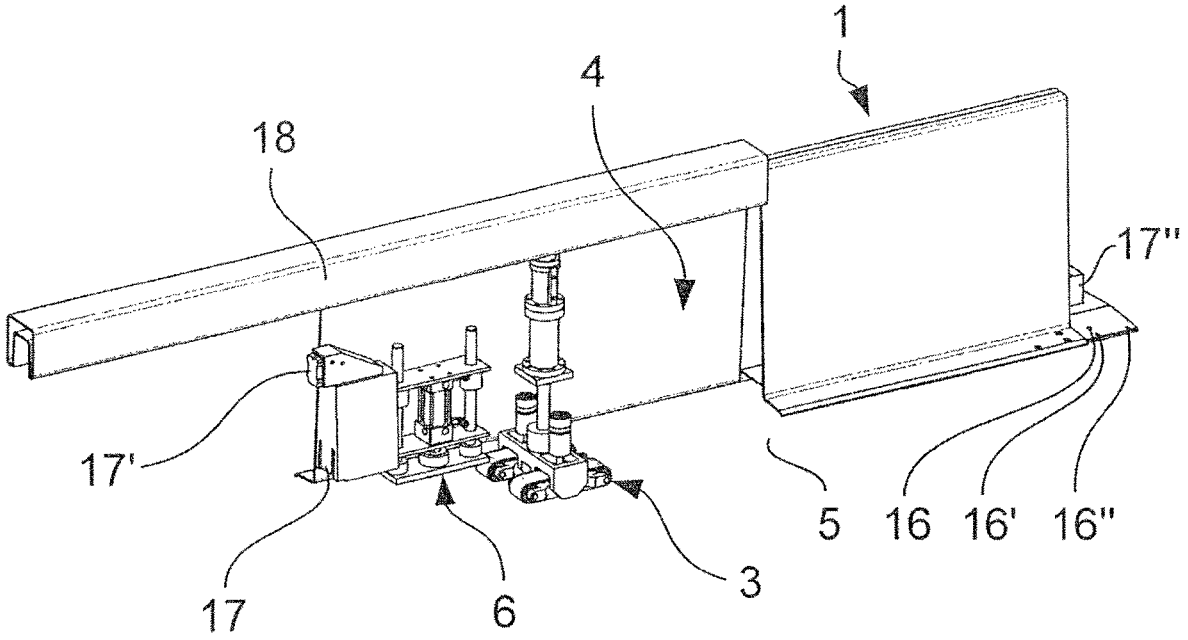
FIG. 7: depiction according to FIG. 6, but with the lifting device retracted.
Figure 8:
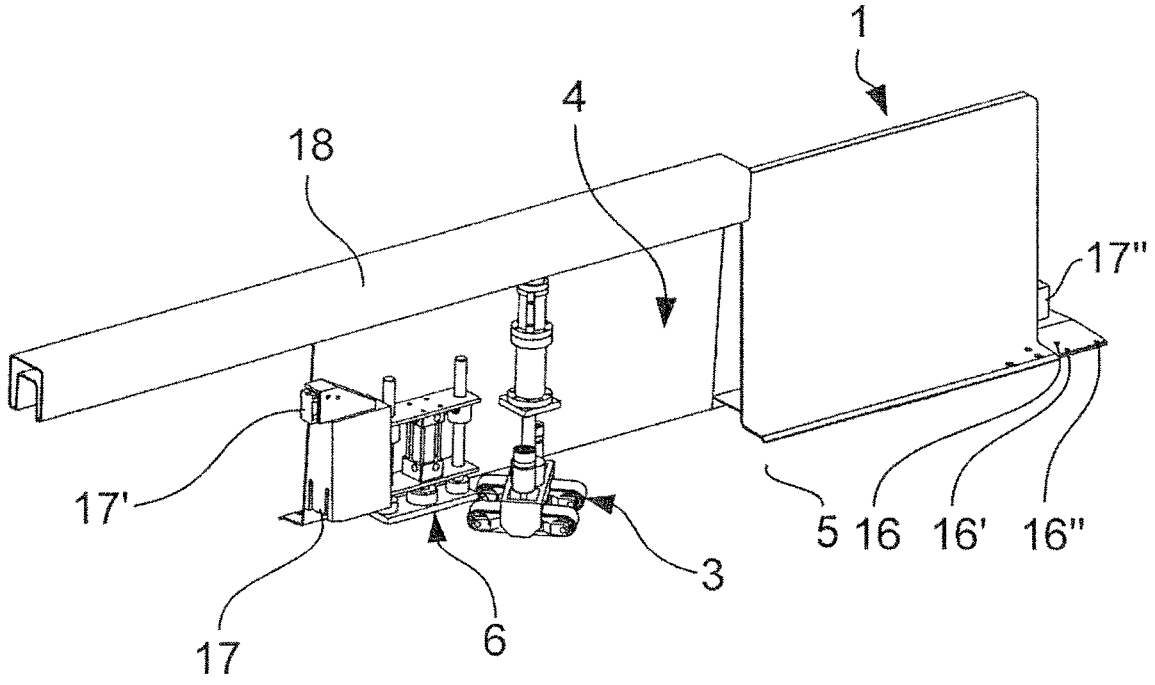
FIG. 8: depiction according to FIG. 7, but with the travelling gear pivoted through 45 degrees.

A situation corresponding to FIG. 7 is shown in FIG. 8, but in this case the travelling gear 3 is only pivoted through 45 degrees. The crash barrier section 1 can thus be moved in a direction lying between its transverse and longitudinal directions by means of the travelling gear 3.

Figure 9:
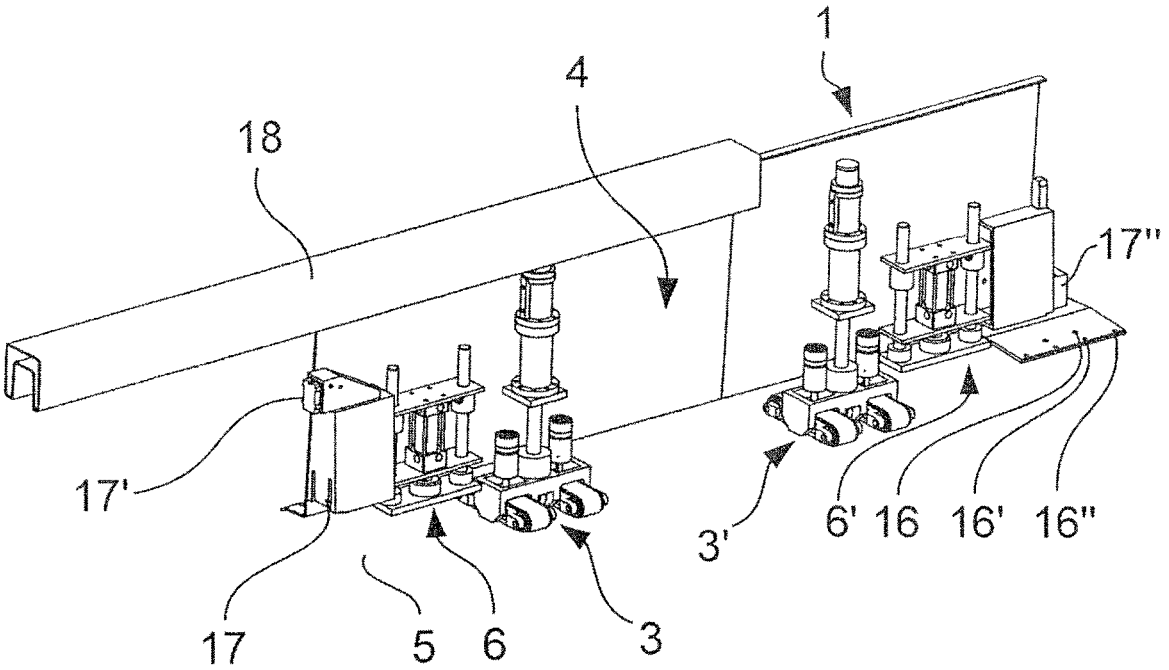
FIG. 9: perspective depiction of a further exemplary embodiment of a crash barrier section according to the invention with two travelling gears and two lifting devices, with front limb of the deflection body removed.
Figure 10:
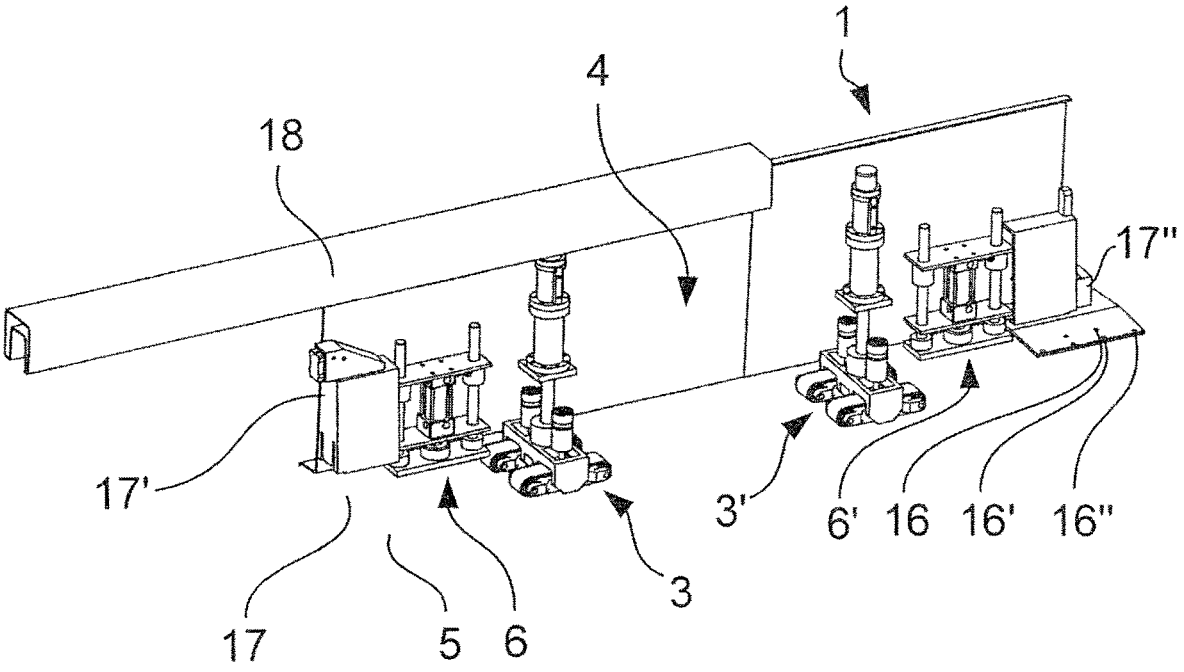
FIG. 10: depiction according to FIG. 9, but with the travelling gears with direction of travel in the longitudinal direction of the crash barrier section.

FIGS. 9 and 10 show an alternative exemplary embodiment of a crash barrier section 1 according to the invention with in each case two travelling gears 3 and 3' and two lifting devices 6 and 6'. The two travelling gears 3 and 3' can be controlled here optionally simultaneously, but in any case individually. FIG. 9 shows the two travelling gears 3 and 3' with their direction of travel oriented transversely to the longitudinal direction of the crash barrier section 1, whereas FIG. 10 shows the two travelling gears 3 and 3' with their direction of travel oriented in the longitudinal direction of the crash barrier section.

Figure 11:
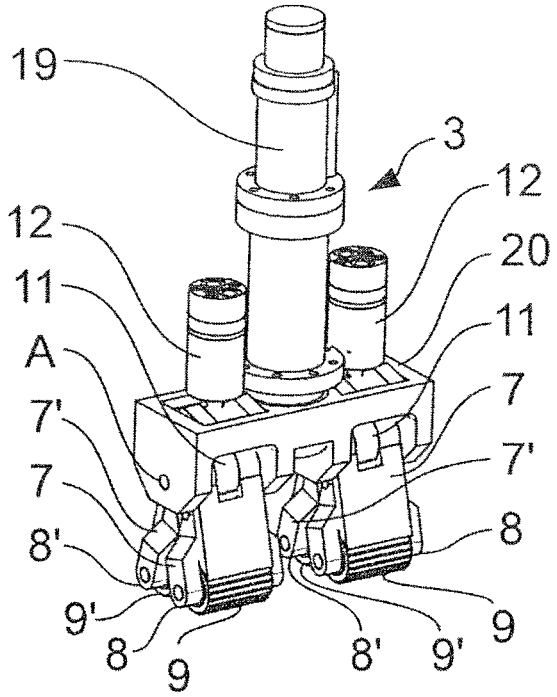
FIG. 11: perspective individual depiction of a travelling gear of a crash barrier section according to the invention in the standby position.

FIG. 11 shows details of the travelling gear 3 in the standby position. The travelling gear 3 comprises a lifting and rotary cylinder 19, by which the travelling gear can be extended from its standby position in the receptacle 4 of the deflection body 2 into the displacement position. The travelling gear 3 comprises a main body 20, to which the rocker arms 7 and 7' are attached, in each case in pairs. The rollers 9 and 9' are arranged at the free ends 8 and 8' of the rocker arms 7 and 7'. In the present drawing, the travelling gear 3 is shown without caterpillar track 10, such that the tooth profile on the rollers 9 is clearly visible. The rocker arms 7' each have a finger 11, which protrudes beyond the axis A and which maintains the tension of the caterpillar track 10 when the travelling gear is in its standby position. The travelling gear 3 is driven via the hydraulic motors 12, wherein a separate hydraulic motor 12 is provided for each rocker arm pair 7 and 7' with a caterpillar track 10 (not shown here).

Figure 12:
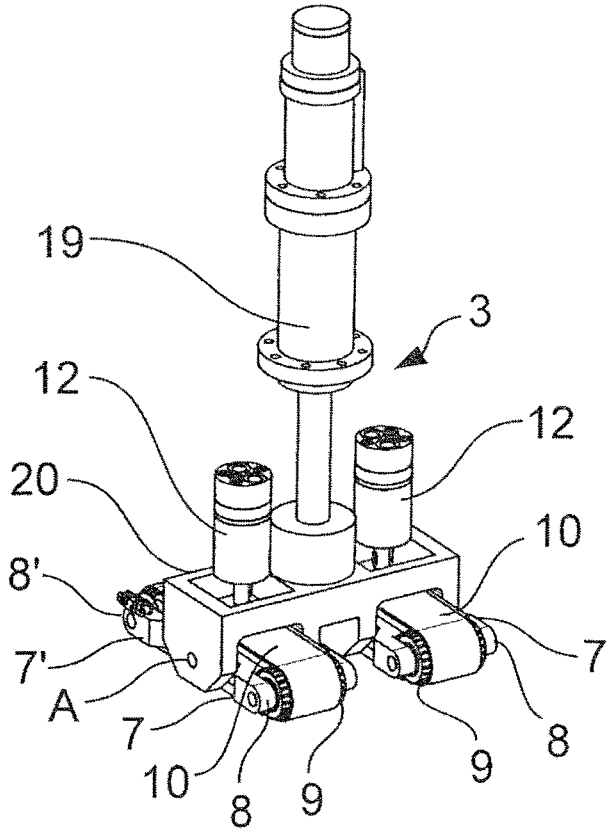
FIG. 12: perspective depiction of a travelling gear according to FIG. 11, but in the displacement position.

Further details of the travelling gear shown in FIG. 11 are shown in greater detail in FIG. 12, but in the displacement position of said travelling gear. The rocker arms 7 and 7' are pivoted away from one another in each case and enclose an angle of 180°. The travelling gear 3 is thus movable on the support 5. The motors 12 can be operable exclusively in the same direction, such that they are used merely to drive the travelling gear. The travelling gear is then controlled by the lifting and rotary cylinder 19, which not only can raise and lower the travelling gear 3, but can also pivot or rotate it about a vertically oriented height axis by means of a separate pivot drive. However, a pivot drive can also be omitted from the lifting and rotary cylinder 19. The travelling gear is then controlled by oppositely directed or one-sided operation of the hydraulic motors 12.

Figure 13:
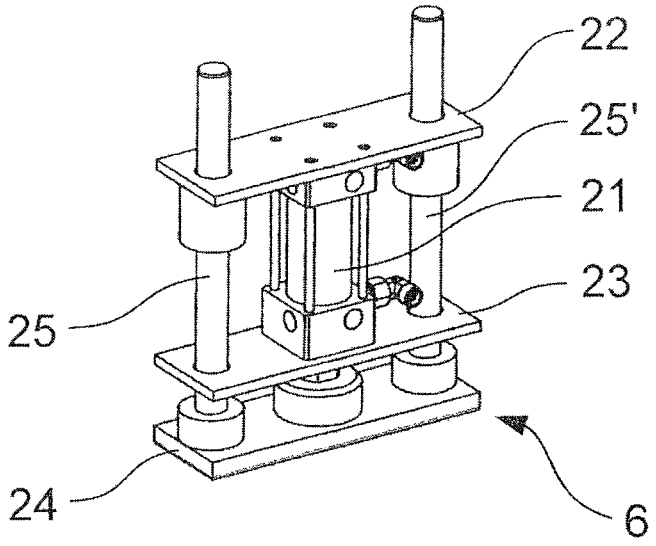
FIG. 13: perspective individual depiction of a lifting device of a crash barrier section according to the invention in the retracted state.
Figure 14:
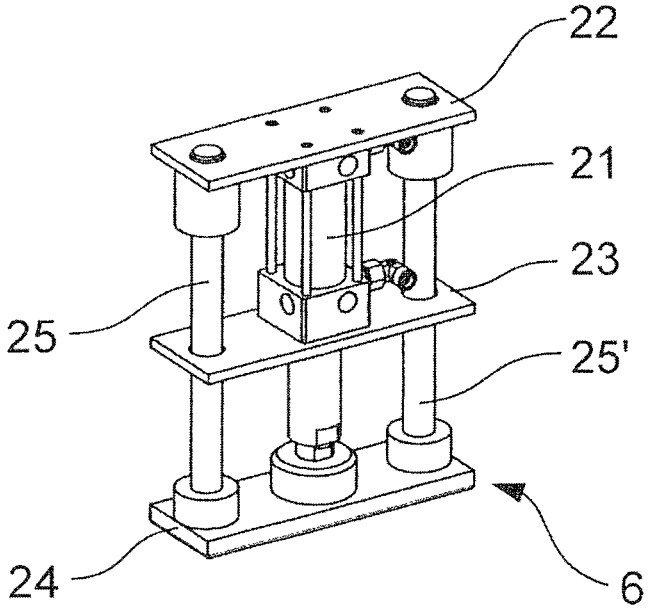
FIG. 14: perspective individual depiction of a lifting device according to FIG. 13, but in the extended state.
Figure 15:
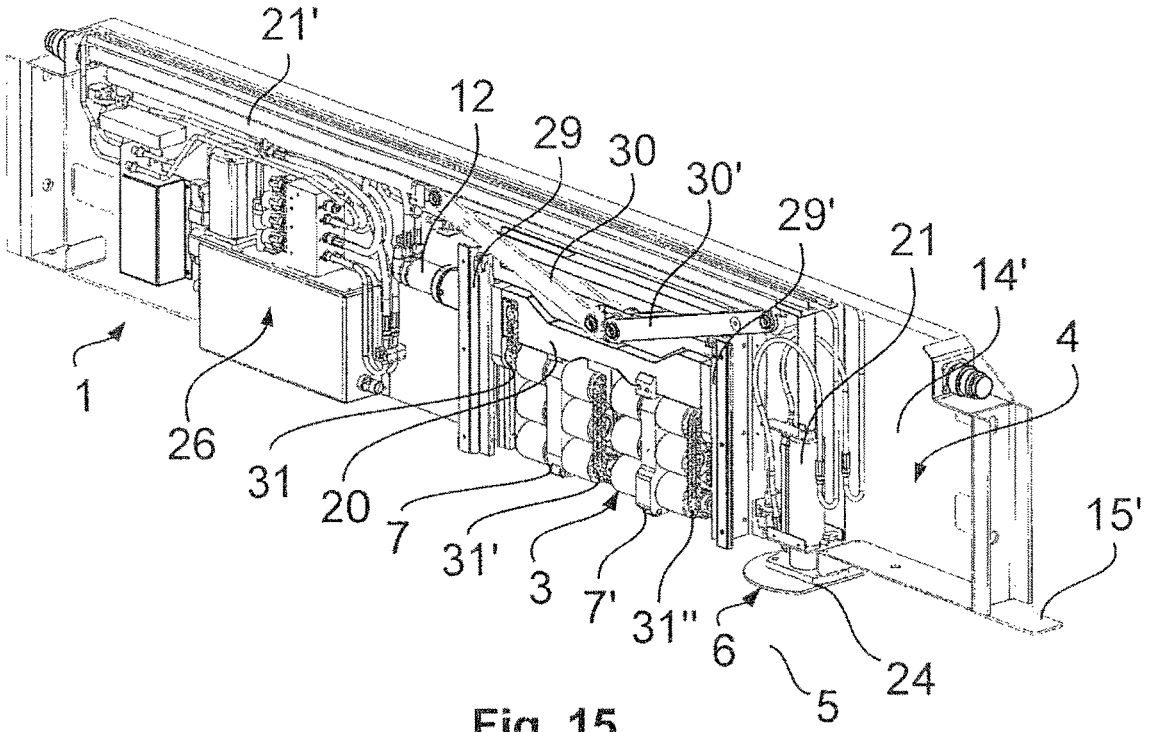
FIG. 15: perspective depiction of a further alternative exemplary embodiment of a crash barrier section according to the invention with travelling gear and lifting device retracted and front limb of the deflection body removed.

Finer details of the lifting device 6 of a crash barrier section 1 according to the invention can be seen in FIGS. 13 and 14. The lifting device 6 is connected to the deflection body 2 via the mounting plate 22. In the present embodiment a hydraulic cylinder 21 is attached to the mounting plate 22. The hydraulic cylinder 21 acts on the support plate 24, by means of which the crash barrier section 1 can be lifted from its support. In order to prevent a rotation of hydraulic cylinder 21 and support plate 24 during the raising and lowering, the support plate 24 is guided via two guide rods 25 and 25'. In order to ensure reliable guidance, besides the mounting plate 22, a guide plate 23 is additionally attached to the opposite end of the hydraulic cylinder 21. FIG. 13 shows the lifting device 6 in the retracted state, and FIG. 14 shows said device in the extended state.

FIGS. 15 to 18 show a further alternative exemplary embodiment of a crash barrier section 1 according to the invention. The deflection body 2 thereof (not shown completely) is similar in respect of its construction to that described above. In the shown depictions, the front limb 14 has been omitted and merely the rear limb 14' and the substantially horizontally extending end portion 15' have been shown. A travelling gear 3 and a lifting device 6 are likewise arranged in the receptacle 4 of the crash barrier section 1 formed by the deflection body 2. In addition, a hydraulic module 26 is housed in the receptacle 4.

Figure 16:
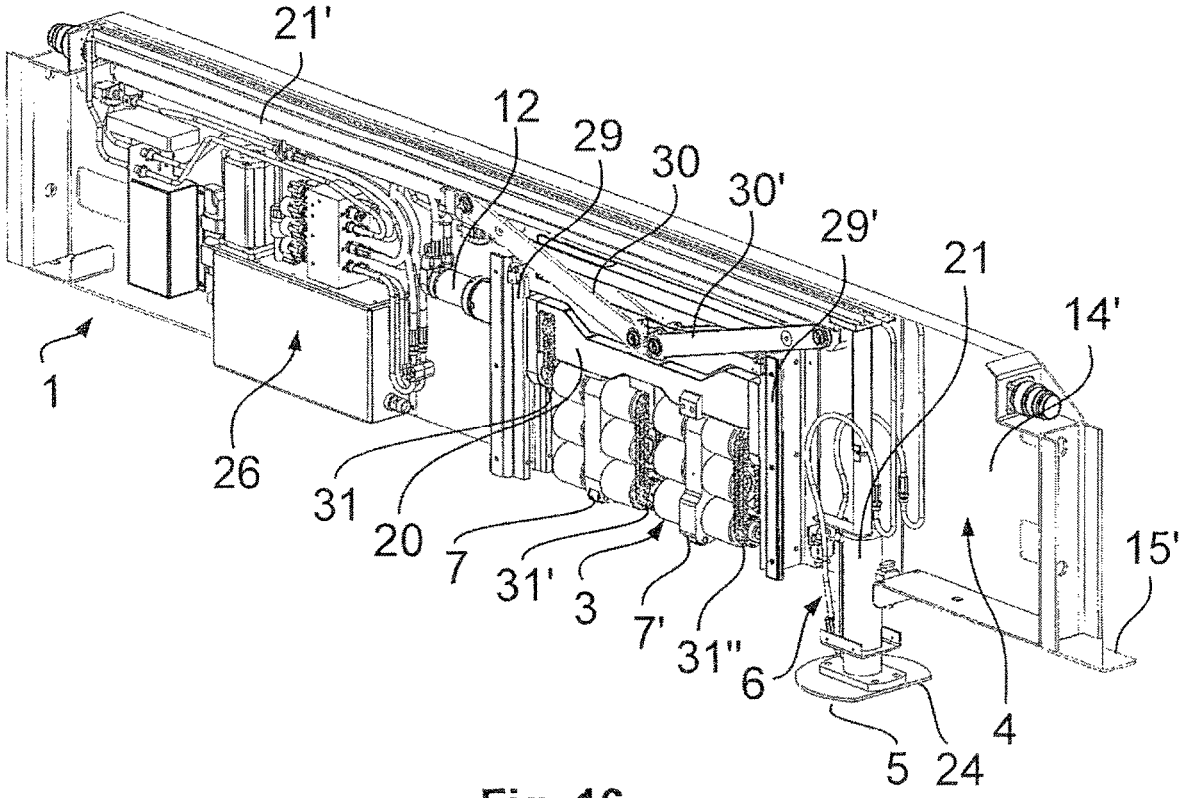
FIG. 16: depiction according to FIG. 15 with lifting device extended.

As can be seen from FIG. 16, the crash barrier section 1 is raised from a support 5 by extending the lifting device 6 in a manner similar to the exemplary embodiments discussed previously.

Figure 17:
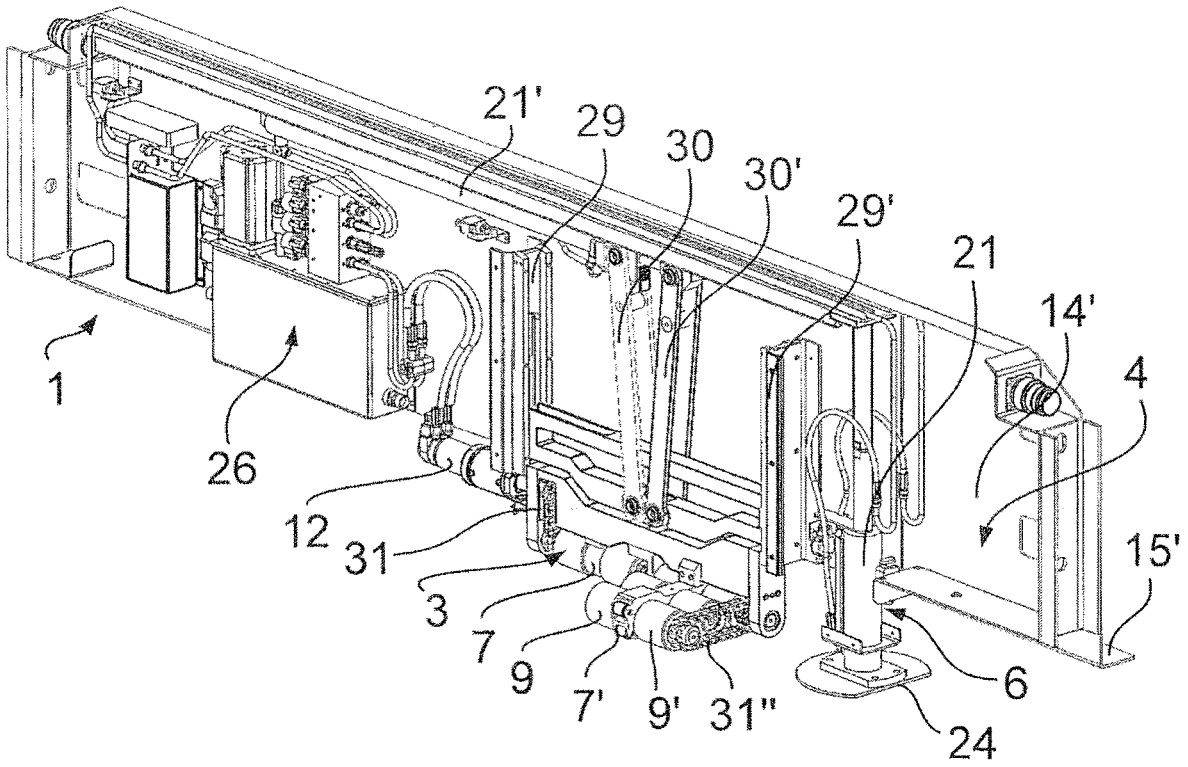
FIG. 17: depiction according to FIG. 16, additionally with travelling gear extended.

In FIG. 17, additionally to the lifting device 6, the travelling gear 3 is also extended in the displacement position from the standby position. The main body 20 of the travelling gear 3 is for this purpose guided by the guide profile 29, 29'. For the extension, a displaceably mounted hydraulic cylinder 21' draws the limbs 30, 30' acting on the main body 20 together uniformly, whereby the travelling gear 3 is extended from the receptacle 4. As a result of this embodiment, in particular the overall height of the travelling gear construction in the retracted state (FIGS. 15 and 16) can be minimised, which is of significance for the installation of the travelling gear 3 in crash barrier systems already established on the market.

Figure 18:
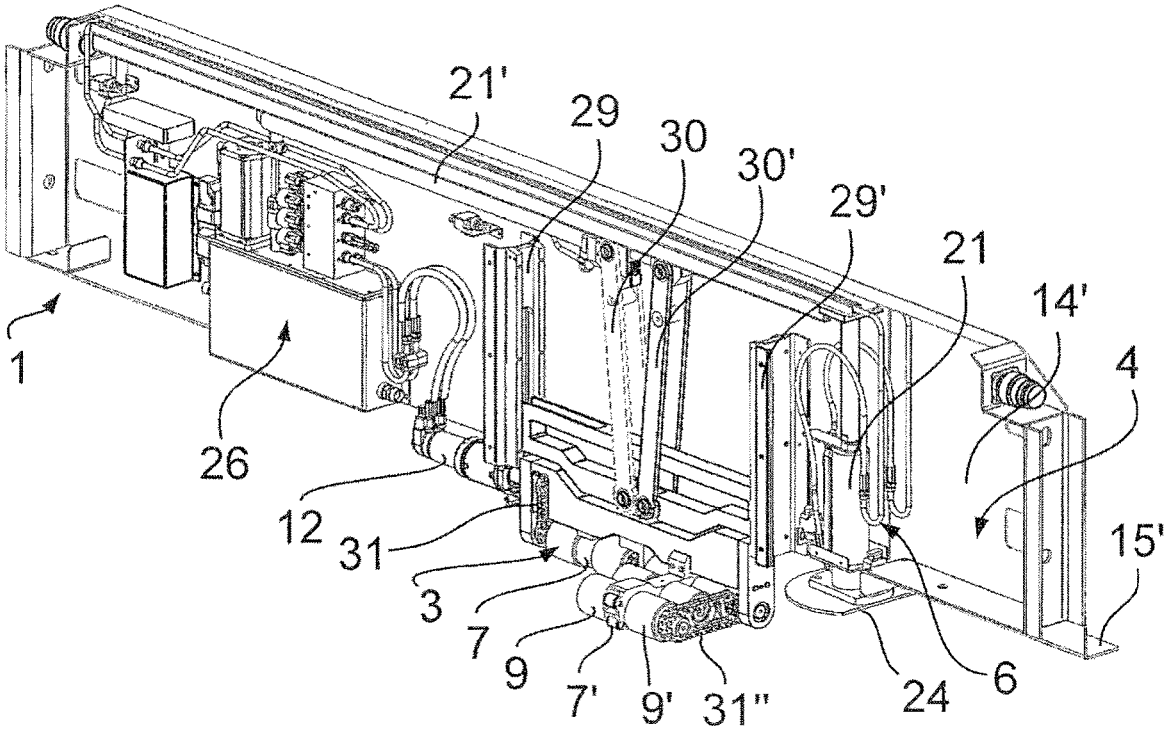
FIG. 18: depiction according to FIG. 17, with lifting device retracted again.

In FIG. 18 the lifting device 6 is retracted again. The crash barrier section 1 now rests from the travelling gear 3. Amongst other things, it can be seen that the travelling gear 3 comprises a pair of rocker arms 7, 7', which are arranged offset on opposite sides on the main body 20. Rollers 9, 9' are attached to the rocker arms 7, 7' on either side (for improved clarity, only some of the rollers have been provided with a reference sign). Some of these rollers 9, 9' are driven by the drive 12, which is also formed here as a hydraulic motor. The drivetrain is formed by the chains 31, 31' and the pivot axis 32.

Figure 19:
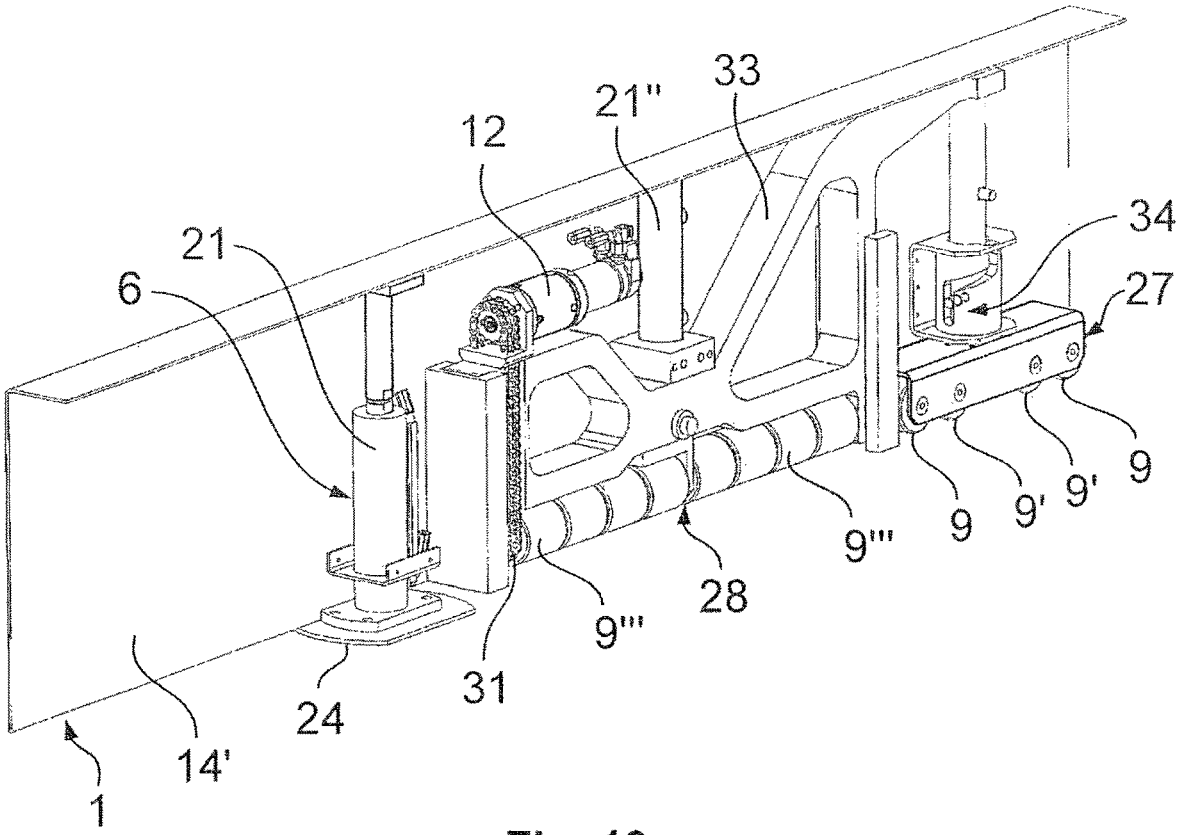
FIG. 19: perspective depiction of a further alternative exemplary embodiment of a crash barrier section according to the invention with supporting travelling gear, bearing travelling gear and lifting device retracted and front limb of the deflection body removed.

FIGS. 19 to 22 show a further alternative exemplary embodiment of a crash barrier section 1 according to the invention. In this case, the travelling gear is embodied as a supporting travelling gear 27. A bearing travelling gear 28 is additionally provided. In FIG. 19 both the supporting travelling gear 27 and the bearing travelling gear 28 are retracted into the receptacle 4 of the crash barrier section 1. The supporting travelling gear 28 is for this purpose rotated with its direction of travel in the longitudinal direction of the crash barrier section. It can thus be housed without difficulty in the receptacle 4. The supporting travelling gear 28 comprises a plurality of rollers 9, 9', which are arranged in succession in the direction of travel. The bearing travelling gear 28 comprises a plurality of rollers 9" (only some of which are provided with a reference sign). In contrast, however, to the supporting travelling gear 27, these rollers are arranged coaxially.

Figure 20:
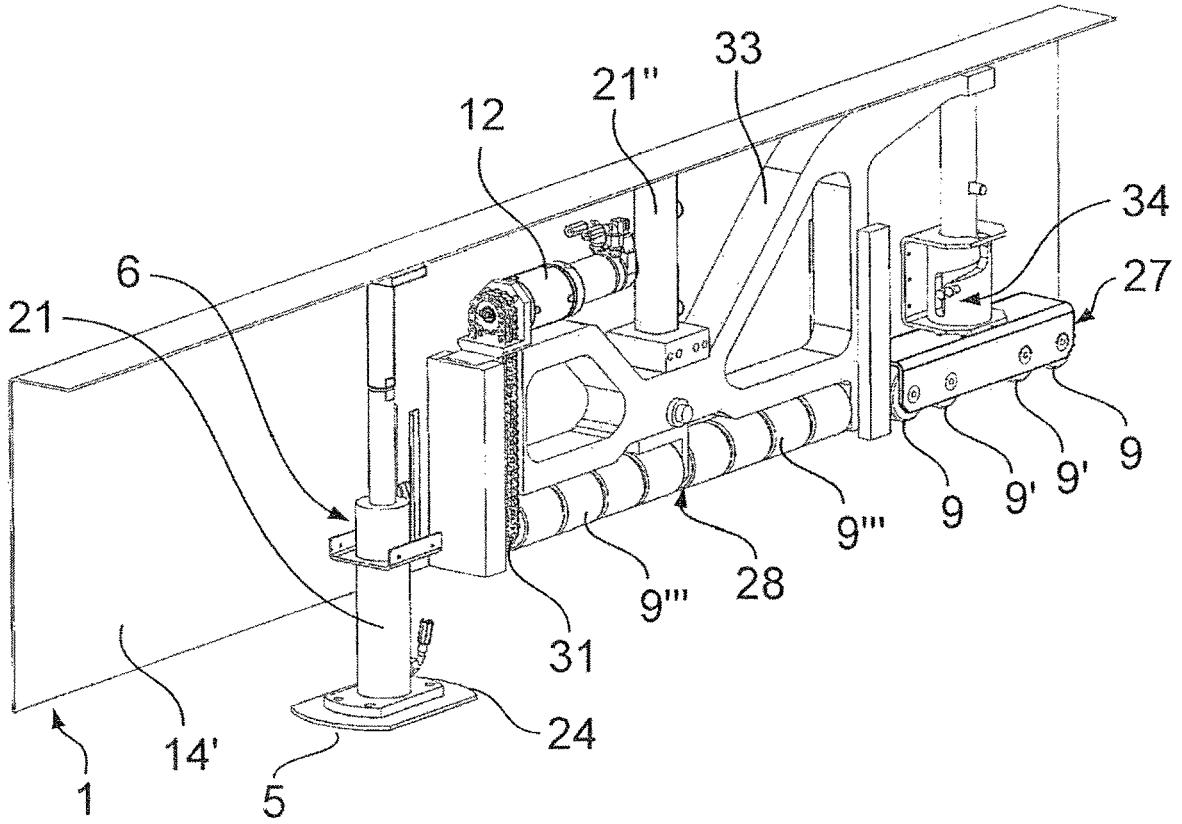
FIG. 20: depiction according to FIG. 19, with lifting device extended.
Figure 21:
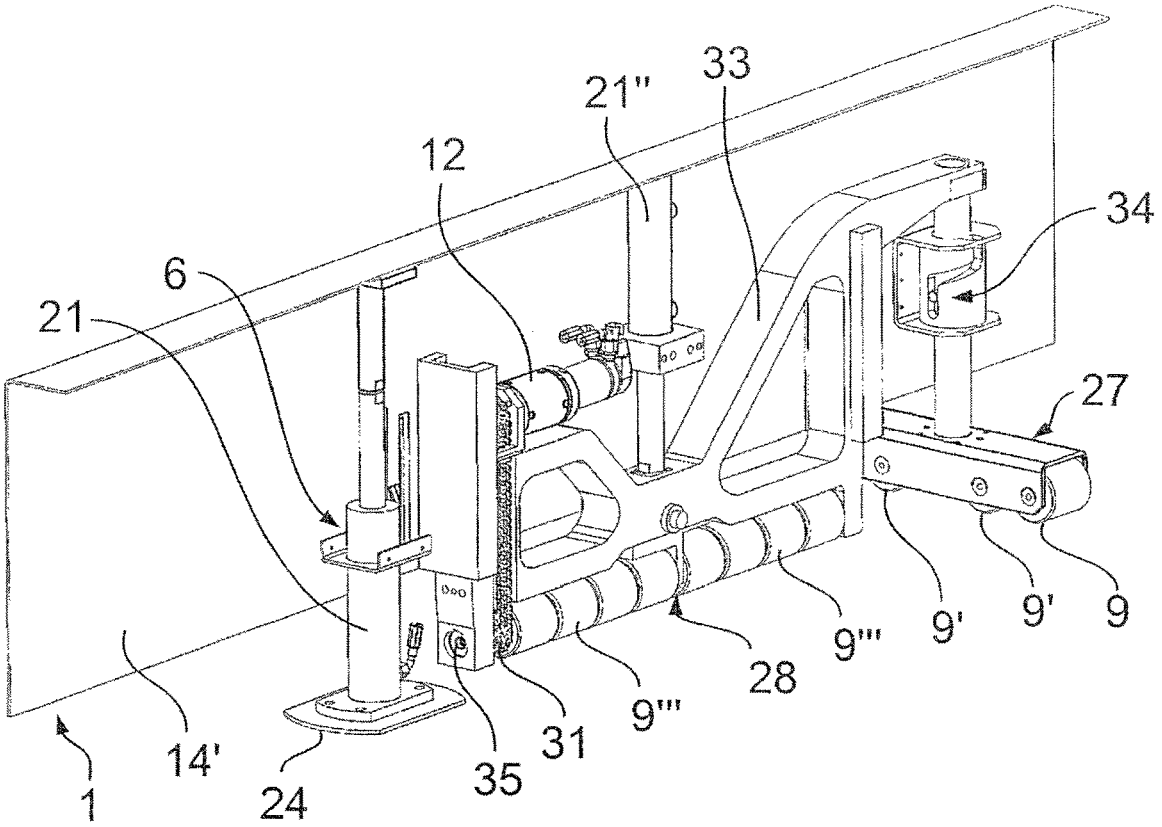
FIG. 21: depiction according to FIG. 20, additionally with supporting travelling gear and bearing travelling gear extended.

In FIG. 20 the crash barrier section 1 is raised from the support 5. This is implemented by means of the lifting device 6, similarly to the previously discussed exemplary embodiments. The supporting travelling gear 27 and the bearing travelling gear 28 can then be extended, as can be seen in FIG. 21. This is implemented by actuating the hydraulic cylinder 21", which acts on the travelling gear frame 33 of the bearing travelling gear 28. The supporting travelling gear 27 is mechanically coupled to the bearing travelling gear 28 via the travelling gear frame 33. As the supporting travelling gear 27 is extended, it can be rotated simultaneously, by means of a slotted guide.

Figure 22:
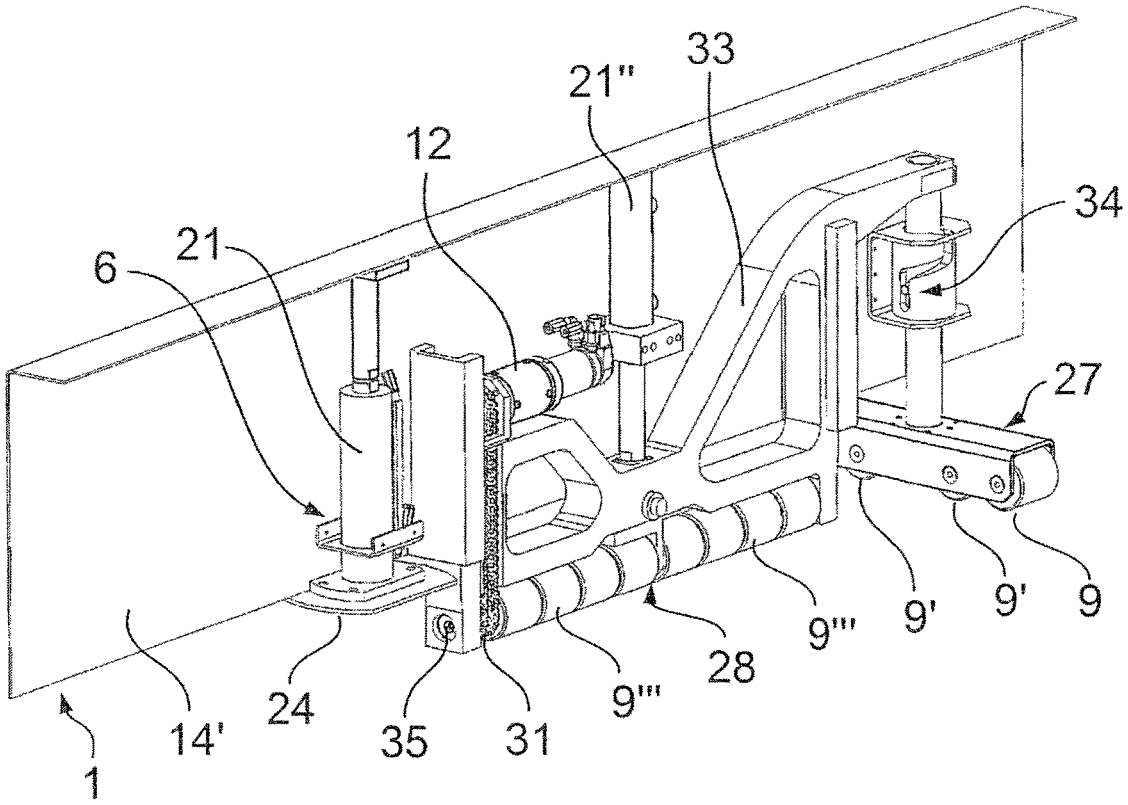
FIG. 22: depiction according to FIG. 21, with lifting device retracted again.

In FIG. 22 the lifting device 6 is retracted again into the receptacle 4. The crash barrier section 1 thus rests substantially on the bearing travelling gear 28, wherein the supporting travelling gear 27 takes on a supporting function and prevents the crash barrier section from tipping over. The crash barrier section 1 is movable via the drive 12. This is coupled to the axis 35 of the bearing travelling gear 28 via the chain 31.

Figure 23:
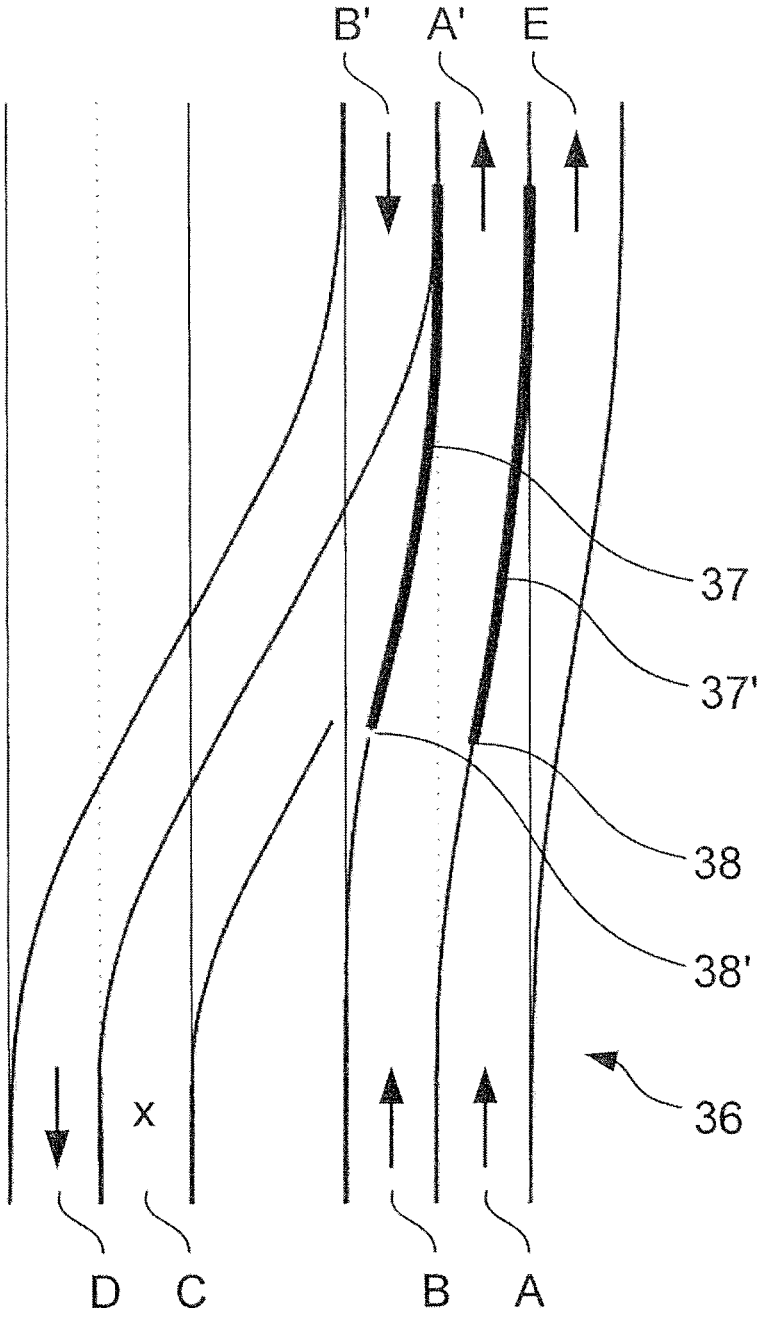
FIG. 23: depiction of a road turnout according to the invention in a first state.
Figure 24:
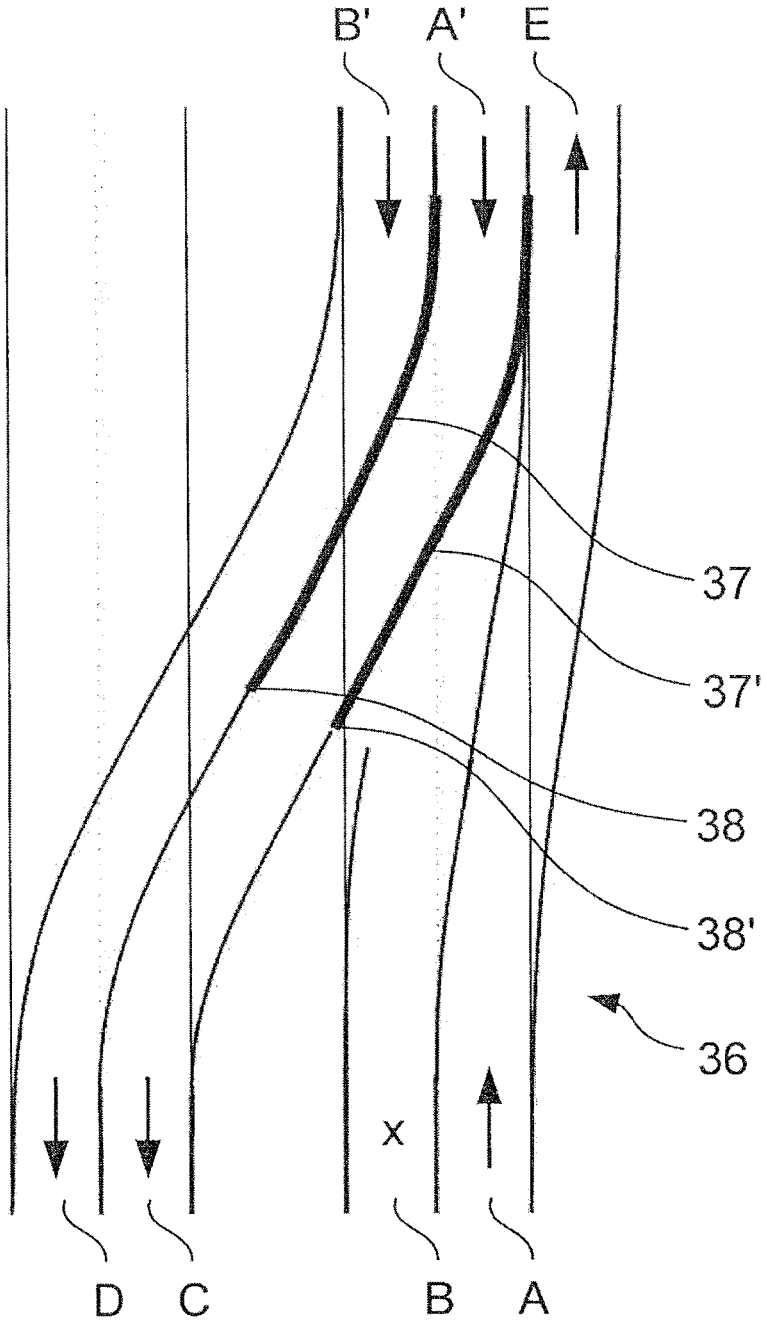
FIG. 24: depiction of a road turnout according to the invention in a second state.

FIGS. 23 and 24 explain the application of a road turnout 36 according to the invention in an exemplary manner. The starting position is a four-lane motorway with the lanes A, B, C and D. The lanes C and D have to be blocked off, for example for resurfacing. The traffic, for this reason, must be diverted over three lanes into lanes A' and B', and a further lane E. The starting position is FIG. 23. Here, the traffic is guided in a first direction in lanes A and B, which transition by means of the road turnout 36 into lanes A' and E. In a second direction, the traffic is guided in the three-lane section only in lane B'. This lane transitions into lane D, whereas lane C is blocked off in the region of the road turnout. However, the traffic can be guided in two lanes again in lanes C and D after the road turnout.

FIG. 24 shows the road turnout 36 after it has been reworked. The switches 37, 37' (shown here as thick lines) are to this end each equipped with a plurality of movable crash barrier sections 1 as described above. The switches 37, 37' are flexible in the horizontal direction. By separately controlling the individual travelling gears 3, the bend of the switches can be ideally adapted or precisely defined, such that the course of the lane can also be adapted or defined in this way. The lane A now transitions into lane E. The lane B is blocked off in the region of the road turnout 36. The lanes C and D transition into the lanes A' and B'. With the shown road turnout the traffic can thus be guided electively in two lanes or one lane in the first or second direction.

In order to increase the safety of the road turnout in the event of a vehicle impact, the ends 38, 38' of the switches 37, 37' can be releasably connectable at their end faces to the further fixed crash barrier design so as to have high tensile strength, in particular in a form-fitting manner, optionally additionally also in a frictionally engaged manner.

The invention claimed is:

1. A crash barrier section comprising a deflection body having at least one traveling gear that is movable between a standby position and a displacement position, wherein the at least one traveling gear is retracted in the standby position in a receptacle of the deflection body and is extended in the displacement position from the receptacle in such a manner that the crash barrier section is movable on a support, the crash barrier section additionally comprises a lifting device by which the crash barrier section can be raised from the support for extending and retracting the traveling gear in such a way that a weight of the crash barrier section is prevented from acting on the traveling gear as the traveling gear is being extended and retracted, wherein a supporting traveling gear and the at least one traveling gear are mechanically coupled to one another for at least one of extension or retraction, and wherein the at least one traveling gear is formed as the supporting traveling gear and the crash barrier section additionally comprises at least one bearing traveling gear, which is retractable into a standby position in the receptacle of the deflection body and is extendible into a displacement position outside the receptacle of the deflection body.

2. The crash barrier section according to claim 1, wherein the at least one bearing traveling gear has at least two coaxially arranged rollers with a direction of travel in a transverse direction of the crash barrier section.

3. The crash barrier section according to claim 1, wherein the at least one traveling gear is pivotably or rotatably mounted.

4. The crash barrier section according to claim 3, wherein the traveling gear is pivotable or rotatable simultaneously during at least one of extension or retraction.

5. The crash barrier section according to claim 3, wherein the at least one traveling gear is pivotably or rotatably mounted about vertically oriented height axis.

6. The crash barrier section according to claim 5, wherein the traveling gear is retractable into the standby position with a direction of travel in a longitudinal direction of the crash barrier section, and in the displacement position a direction of travel in a transverse direction of the crash barrier section is provided.

7. The crash barrier section according to claim 6, wherein the traveling gear comprises at least two rollers arranged successively in the direction of travel, and an axial spacing of the at least two rollers, at least in the displacement position, is greater than a maximum cross-sectional width of the receptacle.

8. A crash barrier system comprising a plurality of adjustable crash barrier segments which can be connected to one another, at end faces thereof, so as to have high tensile strength, wherein at least one movable crash barrier segment according to claim 1, can be inserted between two adjustable crash barrier segments whereby the adjustable crash barrier segments are raisable and movable.

9. The crash barrier system according to claim 8, wherein a plurality of traveling gears can be controlled sequentially or simultaneously.

10. The road turnout having at least one adjustable switch, and the at least one adjustable switch comprising at least one crash barrier section according to claim 1.

11. The road turnout according to claim 10, wherein the at least one adjustable switch is mounted pivotably in a horizontal direction about a substantially vertically oriented axis.

12. The road turnout according to claim 10, wherein the at least one adjustable switch is designed so as to be flexible in a horizontal direction.

13. The road turnout according to claim 10, wherein a plurality of traveling gears can be controlled sequentially or simultaneously.

14. A method for shifting a crash barrier section according to claim 1, comprising the following steps:

i. moving the at least one traveling gear of the crash barrier section from the standby position into the displacement position;

ii. moving the crash barrier section on the support by the at least one traveling gear;

iii. moving the at least one traveling gear from the displacement position into the standby position, wherein the crash barrier section, in order to move the at least one traveling gear into the standby position or into the displacement position, is raised from the support by a lifting device and is then lowered again, wherein the at least one traveling gear is formed as a supporting traveling gear and the crash barrier section additionally comprises at least one bearing traveling gear, which is retractable into a standby position in the receptacle of the deflection body and is extendible into a displacement position outside the receptacle of the deflection body, and wherein the supporting traveling gear and the at least one bearing traveling gear are mechanically coupled to one another for at least one of the extension or retraction.

15. The method according to claim 13, wherein the crash barrier section is raised from the support by the lifting device and is then lowered again in order to choose a direction of travel.

16. A crash barrier section comprising:

a deflection body having at least one traveling gear that is movable between a standby position and a displacement position;

wherein the at least one traveling gear is retracted in the standby position in a receptacle of the deflection body and is extended in the displacement position from the receptacle in such a manner that the crash barrier section is movable on a support;

the crash barrier section additionally comprises a lifting device by which the crash barrier section can be raised from the support for extending and retracting the traveling gear;

the at least one traveling gear is formed as a supporting traveling gear and the crash barrier section additionally comprises at least one bearing traveling gear, which is retractable into a standby position in the receptacle of the deflection body and is extendible into a displacement position outside the receptacle of the deflection body; and the supporting traveling gear and the at least one bearing traveling gear are mechanically coupled to one another for at least one of the extension or retraction.

* * * * *